US007652640B2

(12) United States Patent
Moon

(10) Patent No.: US 7,652,640 B2
(45) Date of Patent: Jan. 26, 2010

(54) PLASMA DISPLAY APPARATUS AND METHOD OF DRIVING THE SAME

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 737 days.

(21) Appl. No.: 11/483,617

(22) Filed: Jul. 11, 2006

(65) Prior Publication Data

US 2007/0013617 A1 Jan. 18, 2007

(30) Foreign Application Priority Data

Jul. 12, 2005 (KR) ..... 10-2005-0062995

(51) Int. Cl.
*G09G 3/28* (2006.01)
*G09G 3/10* (2006.01)

(52) U.S. Cl. ..... 345/60; 345/68; 315/169.4

(58) Field of Classification Search ..... 345/60–72, 345/204–214; 315/169.4
See application file for complete search history.

(56) References Cited

U.S. PATENT DOCUMENTS

| | | | | |
|---|---|---|---|---|
| 7,358,931 | B2 * | 4/2008 | Mizobata et al. | 345/60 |
| 2001/0030513 | A1 | 10/2001 | Takada et al. | 315/169.4 |
| 2003/0231146 | A1 | 12/2003 | Lee et al. | 345/60 |

FOREIGN PATENT DOCUMENTS

| | | | |
|---|---|---|---|
| CN | 1444198 | A | 9/2003 |
| EP | 0 811 963 | A1 | 12/1997 |
| EP | 1 345 199 | A2 | 9/2003 |
| EP | 1 381 018 | A2 | 1/2004 |
| EP | 1 530 190 | A2 | 5/2005 |
| KR | 10-0256092 | B1 | 2/2000 |
| KR | 10-2004-0094087 | A | 11/2004 |

OTHER PUBLICATIONS

Chinese Office Action dated Jun. 5, 2009.
European Office Action dated Jul. 21, 2008.
European Search Report dated Oct. 23, 2006.

* cited by examiner

*Primary Examiner*—David L Lewis
(74) *Attorney, Agent, or Firm*—KED & Associates, LLP

(57) ABSTRACT

A plasma display apparatus is disclosed. The plasma display apparatus includes a plasma display panel comprising a scan electrode and a sustain electrode. When an image displayed on the plasma display apparatus is a fixed image pattern which has a rate of change equal to or less than a threshold rate of change in input image data and is displayed as a picture for a duration equal to or more than a threshold duration of time, the number of sustain pulses or a magnitude of a voltage of a sustain pulse supplied to at least one of the scan electrode or the sustain electrode in a sustain period of a subfield subsequent to the threshold duration of time is controlled.

19 Claims, 7 Drawing Sheets

<Related Art>

PLASMA DISPLAY APPARATUS AND METHOD OF DRIVING THE SAME

This Non-provisional application claims priority under 35 U.S.C. § 119(a) on Patent Application No. 10-2005-0062995 filed in Korea on Jul. 12, 2005 the entire contents of which are hereby incorporated by reference.

BACKGROUND OF THE INVENTION

1. Field of the Invention

This document relates to a display apparatus, and more particularly to, a plasma display apparatus and a method of driving the same.

2. Description of the Background Art

A plasma display apparatus comprises a plasma display panel for displaying an image and a driver for driving the plasma display panel. The driver is attached on a rear surface of the plasma display panel.

In the plasma display panel, a unit discharge cell is defined by barrier ribs disposed between a front substrate and a rear substrate. Each cell is filled with an inert gas containing a main discharge gas such as neon (Ne), helium (He) and a gas mixture of Ne and He, and a small amount of xenon (Xe). The plurality of discharge cells form one pixel. For example, a red (R) discharge cell, a green (G) discharge cell and a blue (B) discharge cell form one pixel.

When the inert gas is discharged due to a high frequency voltage, the inert gas generates vacuum ultraviolet rays, so that the rays excite and radiate a phosphor formed between the barrier ribs, thereby displaying an image.

The plasma display panel comprises a plurality of electrodes, for example, a scan electrode, a sustain electrode and an address electrode. Drivers for supplying a driving voltage to each of the scan, sustain and address electrodes of the plasma display panel are connected to the scan electrode, the sustain electrode and the address electrode, respectively.

When driving the plasma display panel, the drivers supply a reset pulse in a reset period, a scan pulse in an address period, and a sustain pulse in a sustain period to the scan, sustain and address electrodes of the plasma display panel, such that the image is displayed. Since the above-described plasma display apparatus can be manufactured to be thin and light, the plasma display apparatus has been considered as a display apparatus.

In the related art plasma display apparatus thus driven, image sticking occurs on the screen due to various factors affecting the discharge of the plasma display panel such as the phosphor.

FIG. 1 illustrates image retention generated in a related art plasma display panel.

As illustrated in (a) of FIG. 1, a discharge is locally generated in a predetermined portion 12 of a display surface 10 of the plasma display panel. As illustrated in (b) of FIG. 1, when the generation of the discharge in the predetermined portion 12 stops or a different image is displayed, the predetermined portion 12 is considered as image retention of a next image.

When the same image is continuously displayed or a change in an image is little, the image retention is seriously generated. For example, when there is no change in image data that is continuously input, or a rate of change in image data is equal to or less than a threshold rate of change of image data, the sustain pulses with the same pattern or similar pattern are applied within the discharge cell. Therefore, the state of the wall charges distributed within the discharge cell is fixed. Further, the various factors affecting the discharge such as the phosphor greatly affect the image sticking. As a result, an image directly before a fixed image pattern is displayed on the display surface 10 as image retention of a next image, thereby increasing image sticking.

With a recent tendency of the plasma display apparatus to achieve high brightness, for example, there is a method in increasing a peak voltage of the sustain pulse. However, a strong discharge is required to increase the peak voltage of the sustain pulse, thereby exciting a large amount of the phosphor. As a result, the various factors affecting the discharge such as the phosphor greatly affect the image sticking.

SUMMARY OF THE INVENTION

Accordingly, an object of the present invention is to solve at least the problems and disadvantages of the related art.

According to an aspect, there is provided a plasma display apparatus comprising a plasma display panel comprising a scan electrode and a sustain electrode, and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, the number of sustain pulses supplied to at least one of the scan electrode or the sustain electrode in a sustain period of a subfield subsequent to the threshold duration of time is controlled.

According to another aspect, there is provided a plasma display apparatus comprising a plasma display panel comprising a scan electrode and a sustain electrode, and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, a magnitude of a voltage of a sustain pulse supplied to at least one of the scan electrode or the sustain electrode in a sustain period of a subfield subsequent to the threshold duration of time is controlled.

According to still another aspect, there is provided a method of driving a plasma display apparatus comprising a scan electrode and a sustain electrode, comprising when an image displayed on the plasma display apparatus is a fixed image pattern which has a rate of change equal to or less than a threshold rate of change in input image data and is displayed as a picture for a duration equal to or more than a threshold duration of time, controlling the number of sustain pulses or a magnitude of a voltage of a sustain pulse supplied to at least one of the scan electrode or the sustain electrode in a sustain period of a subfield subsequent to the threshold duration of time.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
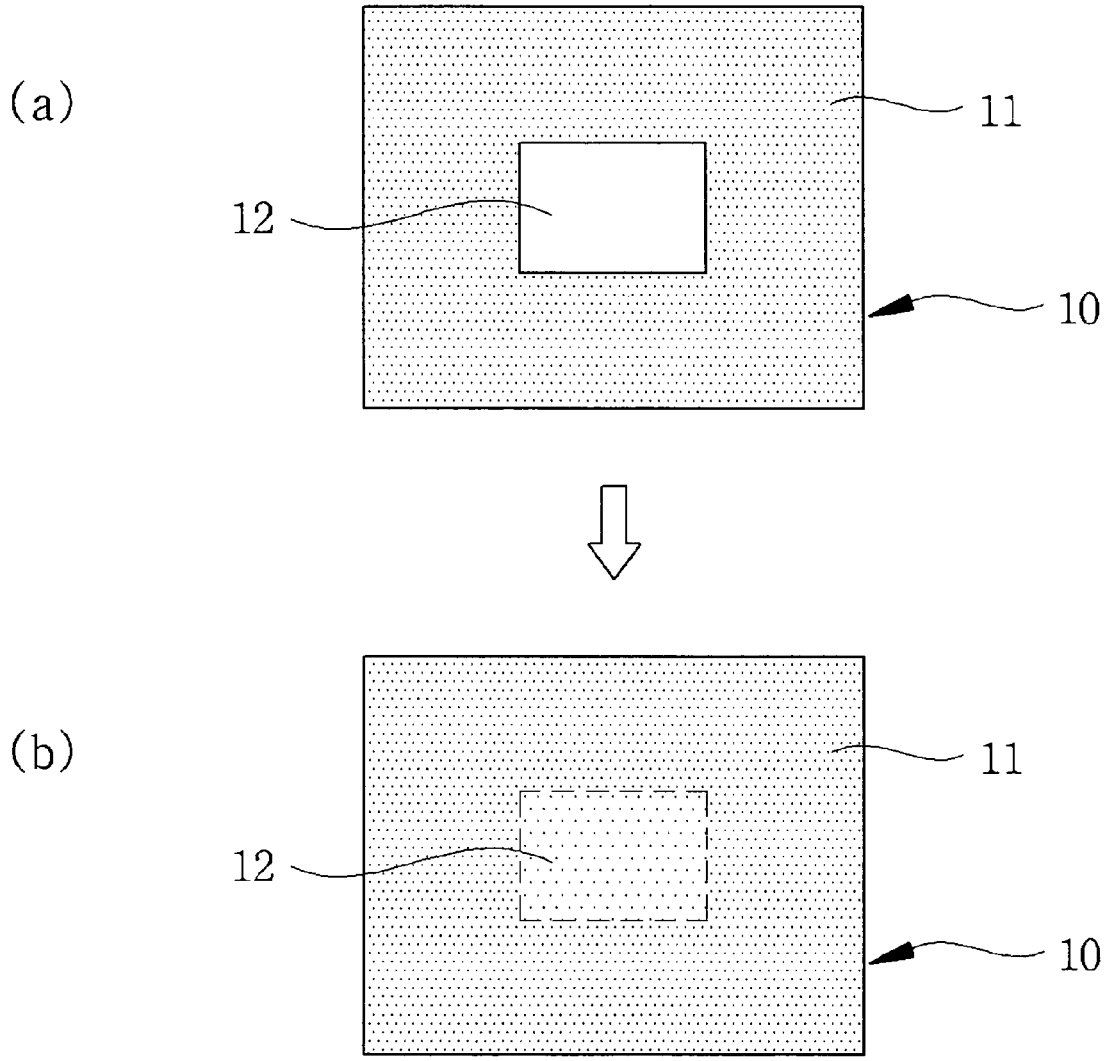
FIG. 1 illustrates image retention generated in a related art plasma display panel.

Preferred embodiments of the present invention will be described in a more detailed manner with reference to the drawings.

A plasma display apparatus according to embodiments of the present invention comprises a plasma display panel comprising a scan electrode and a sustain electrode, and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, the number of sustain pulses supplied to at least one of the scan electrode or the sustain electrode in a sustain period of a subfield subsequent to the threshold duration of time is controlled.

When an image displayed on the plasma display apparatus is the fixed image pattern, the number of sustain pulses supplied to at least one of the scan electrode or the sustain electrode in a sustain period of a subfield subsequent to the threshold duration of time of the fixed image pattern may be less than the number of sustain pulses supplied to at least one of the scan electrode or the sustain electrode in a normal image pattern.

When an image displayed on the plasma display apparatus is the fixed image pattern, the duration of an energy supply period of the sustain pulse supplied to at least one of the scan electrode or the sustain electrode in the sustain period of the subfield subsequent to the threshold duration of time of the fixed image pattern may more than the duration of an energy supply period of a sustain pulse supplied to at least one of the scan electrode or the sustain electrode in the normal image pattern.

The driver may supply a negative sustain pulse to at least one of the scan electrode or the sustain electrode in the sustain period.

The threshold rate of change of the fixed image pattern may be expressed by a percentage of a difference between the image data of a present frame and the image data of a frame directly before the present frame, and the threshold rate of change of the fixed image pattern may be equal to or less than 10% of the total image data input during one frame.

The threshold duration of time of the fixed image pattern may equal 1 second.

As a display duration of time of an image, in which a rate of change in the image data input for the duration equal to or more than the threshold duration of time of the fixed image pattern is equal to or less than the threshold rate of change of the fixed image pattern, increases, the number of sustain pulses supplied to at least one of the scan electrode or the sustain electrode in the sustain period of the subfield subsequent to the threshold duration of time of the fixed image pattern may decrease.

When a display duration of time of an image, in which the rate of change in the image data input for the duration equal to or more than the threshold duration of time of the fixed image pattern is equal to or less than the threshold rate of change of the fixed image pattern, increases, the decrease number of sustain pulses may be fixed.

A plasma display apparatus according to the embodiments of the present invention comprises a plasma display panel comprising a scan electrode and a sustain electrode, and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, a magnitude of a voltage of a sustain pulse supplied to at least one of the scan electrode or the sustain electrode in a sustain period of a subfield subsequent to the threshold duration of time is controlled.

When an image displayed on the plasma display apparatus is the fixed image pattern, a magnitude of a voltage of a sustain pulse supplied to at least one of the scan electrode or the sustain electrode in a sustain period of a subfield subsequent to the threshold duration of time of the fixed image pattern may be less than a magnitude of a voltage of a sustain pulse supplied to at least one of the scan electrode or the sustain electrode in a normal image pattern.

The driver may supply a negative sustain pulse to at least one of the scan electrode or the sustain electrode in the sustain period.

The threshold rate of change of the fixed image pattern may be expressed by a percentage of a difference between the image data of a present frame and the image data of a frame directly before the present frame, and the threshold rate of change of the fixed image pattern may be equal to or less than 10% of the total image data input during one frame.

The threshold duration of time of the fixed image pattern may equal 1 second.

As a display duration of time of an image, in which a rate of change in the image data input for the duration equal to or more than the threshold duration of time of the fixed image pattern is equal to or less than the threshold rate of change of the fixed image pattern, increases, a magnitude of a voltage of a sustain pulse supplied to at least one of the scan electrode or the sustain electrode in the sustain period of the subfield subsequent to the threshold duration of time of the fixed image pattern may decrease.

When a display duration of time of an image, in which the rate of change in the image data input for the duration equal to or more than the threshold duration of time of the fixed image pattern is equal to or less than the threshold rate of change of the fixed image pattern, increases, a magnitude of a voltage of a sustain pulses may be fixed.

A method of driving a plasma display apparatus comprising a scan electrode and a sustain electrode according to the embodiments of the present invention, comprises when an image displayed on the plasma display apparatus is a fixed image pattern which has a rate of change equal to or less than a threshold rate of change in input image data and is displayed as a picture for a duration equal to or more than a threshold duration of time, controlling the number of sustain pulses or a magnitude of a voltage of a sustain pulse supplied to at least one of the scan electrode or the sustain electrode in a sustain period of a subfield subsequent to the threshold duration of time.

When an image displayed on the plasma display apparatus is the fixed image pattern, the number of sustain pulses supplied to at least one of the scan electrode or the sustain electrode in a sustain period of a subfield subsequent to the threshold duration of time of the fixed image pattern may be less than the number of sustain pulses supplied to at least one of the scan electrode or the sustain electrode in a normal image pattern.

The threshold rate of change of the fixed image pattern may be expressed by a percentage of a difference between the image data of a present frame and the image data of a frame directly before the present frame, and the threshold rate of change of the fixed image pattern may be equal to or less than 10% of the total image data input during one frame.

The threshold duration of time of the fixed image pattern may equal 1 second.

Hereinafter, exemplary embodiments of the present invention will be described in detail with reference to the attached drawings.

Figure 2:
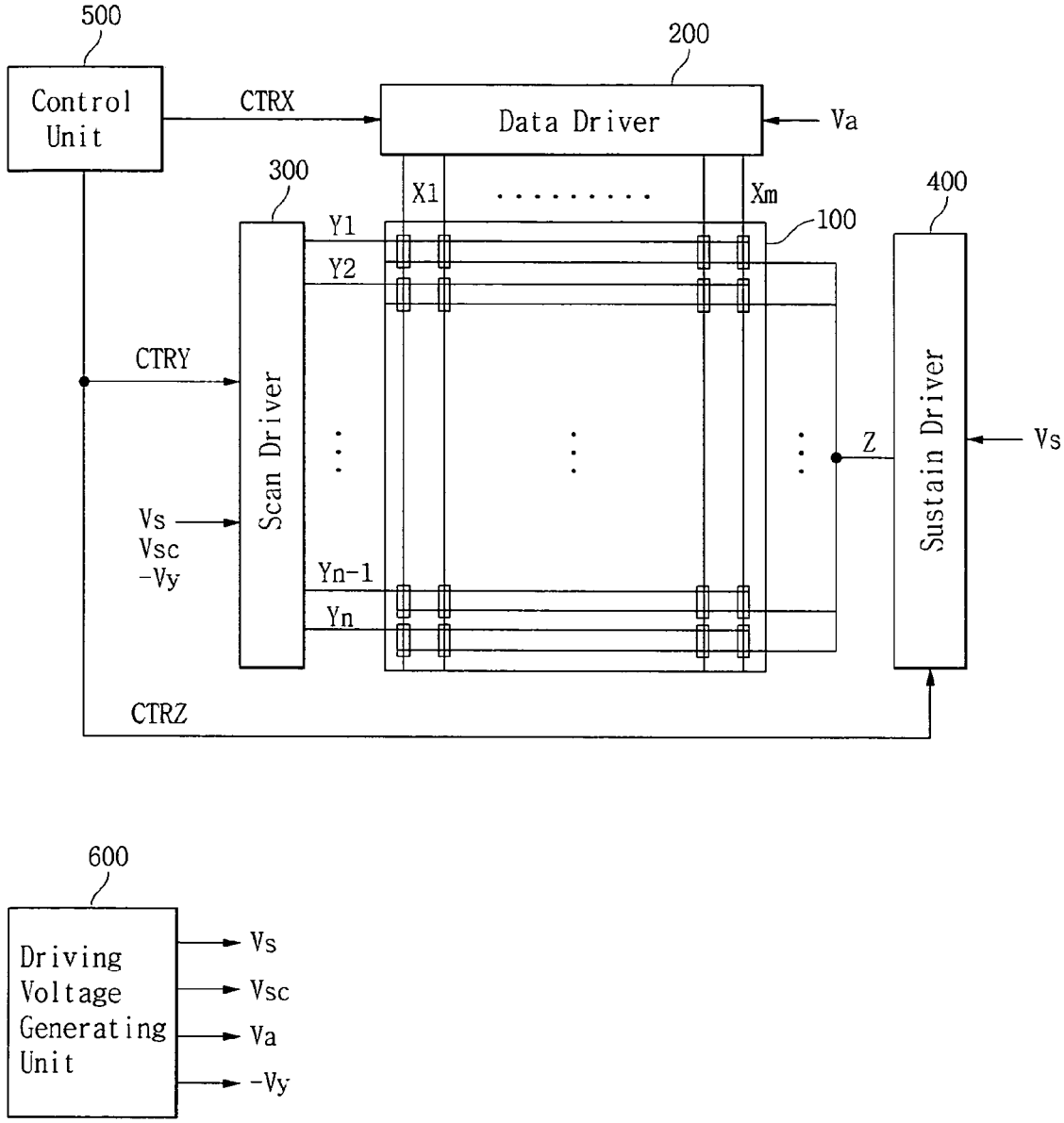
FIG. 2 illustrates a plasma display apparatus according to a first embodiment of the present invention.

FIG. 2 illustrates a plasma display apparatus according to a first embodiment of the present invention.

As illustrated in FIG. 2, a plasma display apparatus according to an embodiment of the present invention comprises a plasma display panel 100, on which an image is displayed by processing image data input from the outside, a data driver 200, a scan driver 300, a sustain driver 400, a control unit 500, and a driving voltage generating unit 600. The data driver 200 supplies data to address electrodes X1 to Xm formed in the plasma display panel 100. The scan driver 300 drives scan electrodes Y1 to Yn formed in the plasma display panel 100. The sustain driver 400 drives sustain electrodes Z, formed in the plasma display panel 100, being common electrodes. The control unit 500 controls the data driver 200, the scan driver 300 and the sustain driver 400. The driving voltage generating unit 600 supplies a necessary driving voltage to each of the drivers 200, 300 and 400.

Figure 3:
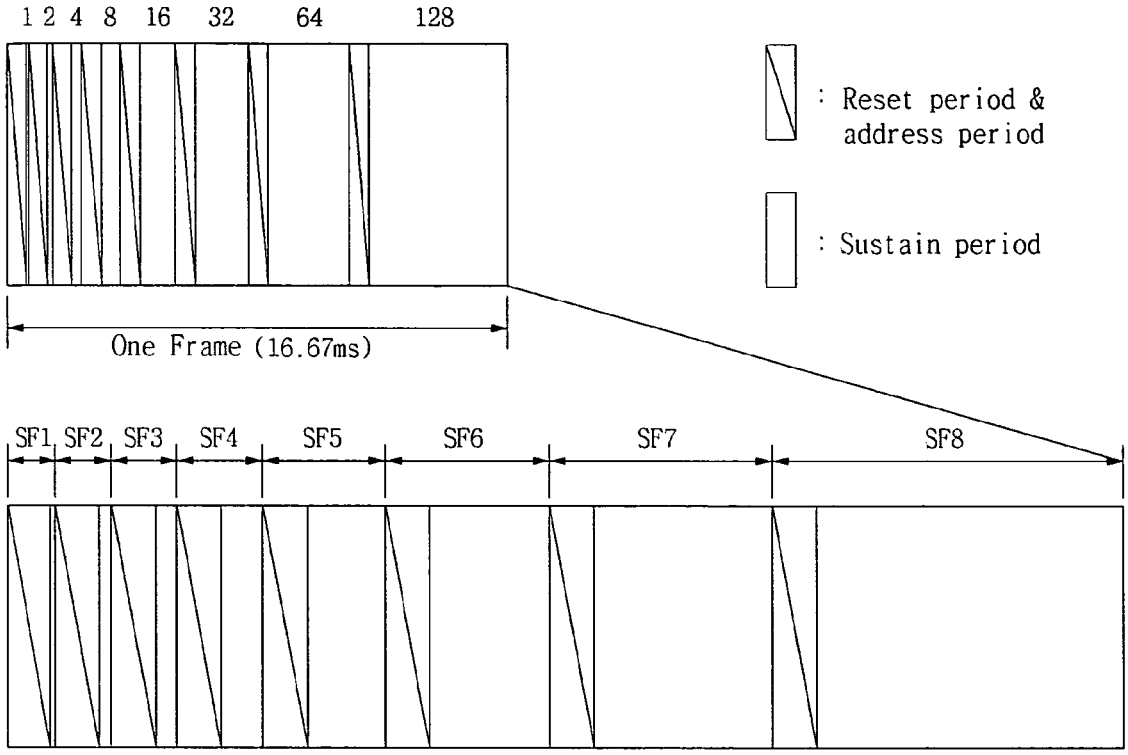
FIG. 3 illustrates an example of a method for representing gray scale of an image in the plasma display apparatus according to the first embodiment of the present invention.

The following is a detailed description of an example of a driving method of the plasma display apparatus, with reference to FIG. 3.

FIG. 3 illustrates an example of a method for representing gray scale of an image in the plasma display apparatus according to the first embodiment of the present invention.

As illustrated in FIG. 3, the plasma display apparatus is driven by dividing one frame into a plurality of subfields, so that the image is displayed on the plasma display panel. Each of the subfields comprises a reset period for initializing all cells, an address period for selecting cells to be discharged, and a sustain period for representing gray scale of the image depending on the number of discharges.

For example, in a case of displaying an image with 256-level gray scale, a frame period (16.67 ms) corresponding to 1/60 second is divided into eight subfields SF1 to SF8. The eight subfields SF1 to SF8 each comprise a reset period, an address period, and a sustain period. The duration of the reset period in a subfield equals to the durations of the reset periods in the remaining subfields. The duration of the address period in a subfield equals to the durations of the address periods in the remaining subfields. The duration of the sustain period and the number of sustain signals supplied in the sustain period increase in a ratio of $2^n$ (n=0, 1, 2, 3, 4, 5, 6, 7) in each of the subfields. As described above, since the duration of the sustain period changes in each of the subfields, gray scale of the image is represented by controlling the duration of the sustain period of each of the subfields (that is, the number of sustain discharges).

Below, the description of the plasma display apparatus of FIG. 2 succeeds.

The plasma display apparatus of FIG. 2 according to the embodiment of the present invention comprises the plasma display panel 100, the drivers 200, 300, and 400, the control unit 500 and the driving voltage generating unit 600.

A front substrate (not shown) and a rear substrate (not shown) of the plasma display panel 100 are coalesced with each other at a given distance. On the front substrate, a plurality of electrodes, for example, the scan electrodes Y1 to Yn and the sustain electrodes Z are formed in pairs. On the rear substrate, the address electrodes X1 to Xm are formed to intersect the scan electrodes Y1 to Yn and the sustain electrodes Z.

The data driver 200 receives data, which is inverse-gamma corrected and error-diffused by an inverse gamma correction circuit (not shown) and an error diffusion circuit (not shown) and then mapped in accordance to a pre-set subfield pattern by a subfield mapping circuit (not shown). The data driver 200 supplies the data, which is sampled and latched under the control of the control unit 500, to the address electrodes X1 to Xm.

Under the control of the control unit 500, the scan driver 300 supplies a reset waveform to the scan electrodes Y1 to Yn during a reset period so that the whole picture is initialized. After the scan driver 300 supplies the reset waveform to the scan electrodes Y1 to Yn, the scan driver 300 supplies a scan reference voltage Vsc and a scan signal, which falls from the scan reference voltage Vsc to a negative voltage level, to the scan electrodes Y1 to Yn during an address period so that scan electrode lines are scanned.

The scan driver 300 supplies a sustain pulse to the scan electrodes Y1 to Yn during a sustain period so that a sustain discharge is generated within the cells selected in the address period.

When an image displayed on the plasma display apparatus is a fixed image pattern which has a rate of change equal to or less than a threshold rate of change in input image data and is displayed as a picture for a duration equal to or more than a threshold duration of time, the scan driver 300 controls the number of sustain pulses or a magnitude of a voltage of a sustain pulse supplied to at least one of the scan electrode or the sustain electrode in a sustain period of one or more subfields of a frame subsequent to the threshold duration of time. This will be described in detail below.

Under the control of the control unit 500, the sustain driver 400 supplies a sustain pulse to the sustain electrodes Z during the sustain period. At this time, the scan driver 300 and the sustain driver 400 alternately operate.

When an image displayed on the plasma display apparatus is a fixed image pattern which has a rate of change equal to or less than a threshold rate of change in input image data and is displayed as a picture for a duration equal to or more than a threshold duration of time, the sustain driver 400 controls the number of sustain pulses or a magnitude of a voltage of a sustain pulse supplied to at least one of the scan electrode or the sustain electrode in a sustain period of one or more subfields of a frame subsequent to the threshold duration of time.

This will be described in detail below.

The control unit 500 receives a vertical/horizontal synchronization signal. The control unit 16 generates timing control signals CTRX, CTRY and CTRZ required in each of the drivers 200, 300 and 400. The control unit 500 supplies the timing control signals CTRX, CTRY and CTRZ to each of the corresponding drivers 200, 300 and 400 to control the drivers 200, 300 and 400. The timing control signals CTRX supplied to the data driver 200 comprises a sampling clock for sampling data, a latch control signal, and a switch control signal for controlling on/off time of an energy recovery circuit and a driving switch element.

The timing control signals CTRY supplied to the scan driver 300 comprises a switch control signal for controlling on/off time of an energy recovery circuit installed in the scan driver 300 and a driving switch element. The timing control signals CTRZ supplied to the sustain driver 400 comprises a switch control signal for controlling on/off time of an energy recovery circuit installed in the sustain driver 400 and a driving switch element.

The driving voltage generating unit 600 generates various driving voltages such as a sustain voltage Vs, a scan reference voltage Vsc, a data voltage Va, a scan voltage −Vy, required in each of the drivers 200, 300 and 400. The driving voltages may be changed depending on a composition of a discharge gas or a structure of the discharge cells.

Figure 4:
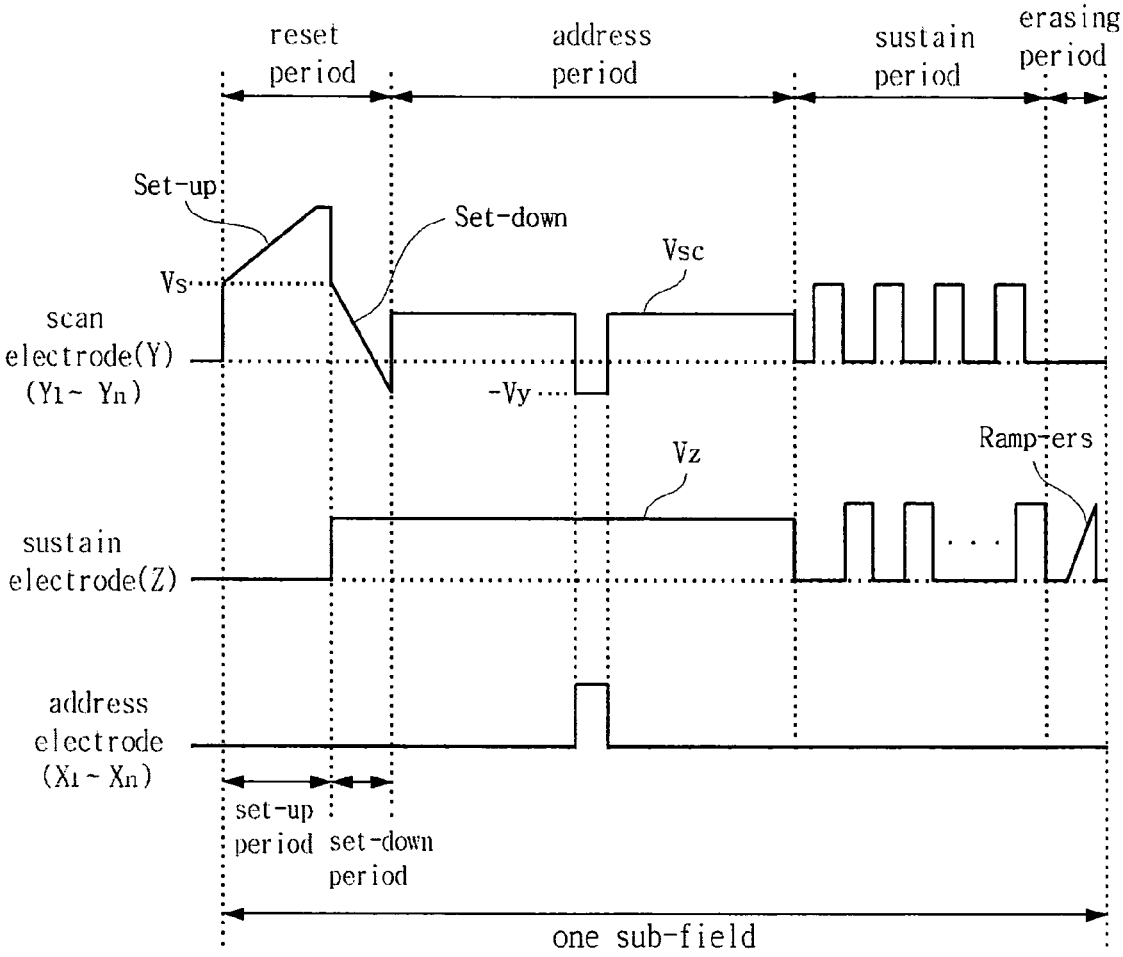
FIG. 4 illustrates a driving waveform in the plasma display apparatus according to the first embodiment of the present invention.

FIG. 4 illustrates an example of a driving waveform in the plasma display apparatus according to the first embodiment of the present invention.

As illustrated in FIG. 4, the plasma display panel is driven by dividing each of subfields into a reset period for initializing all cells, an address period for selecting cells to be discharged, and a sustain period for discharge maintenance of the selected cells. An erasing period for erasing the wall charges within the discharge cell may be included.

In a setup period of the reset period, a setup waveform Set-up is simultaneously applied to all scan electrodes Y. A weak dark discharge occurs within the discharge cells of the whole picture by the setup waveform Set-up. By performing the weak dark discharge, positive wall charges are accumulated on address electrodes X and sustain electrodes Z and negative wall charges are accumulated on the scan electrodes Y.

In a set-down period of the reset period, after supplying the setup waveform Set-up, a set-down waveform Set-down which falls from a positive voltage lower than a peak voltage of the setup waveform to a specific voltage level is supplied to the scan electrodes Y to generate a weak erasure discharge within the discharge cells. The weak erase discharge sufficiently erases the wall charges excessively accumulated on the scan electrode Y. By performing the weak erase discharge, the wall charges uniformly remain within the cells to the degree that there is the generation of a stable address discharge.

In the address period, a negative scan pulse is sequentially applied to the scan electrodes Y and, at the same time, a positive data pulse synchronized with the scan pulse is applied to the address electrodes X. While the voltage difference between the negative scan pulse and the positive data pulse is added to the wall charges produced during the reset period, the address discharge is generated within the discharge cells to which the data pulse is applied. Wall charges remains within the discharge cells selected by the address discharge to a degree by which the discharge can occur when the sustain voltage Vs is applied. A positive voltage Vz is supplied to the sustain electrode Z in at least one of the set-down period or the address period to reduce the voltage difference between the sustain electrode Z and the scan electrode Y. Accordingly, an erroneous discharge between the sustain electrode Z and the scan electrode Y is prevented.

In the sustain period, a sustain pulse is alternately supplied to the scan electrode Y and the sustain electrode Z. While the wall voltage within the cells selected by performing the address discharge is added to the sustain pulse, a sustain discharge (that is, a display discharge) occurs between the scan electrode Y and the sustain electrode Z whenever each sustain pulse is applied.

After the sustain discharge is completed, an erasure waveform Ramp-ers with a small pulse width and a low voltage level is applied to the sustain electrode Z so that wall charges remaining within the discharge cells of the whole picture are erased.

When an image displayed on the plasma display apparatus is a fixed image pattern which has a rate of change equal to or less than a threshold rate of change in input image data and is displayed as a picture for a duration equal to or more than a threshold duration of time, the number of sustain pulses or a magnitude of a voltage of a sustain pulse supplied to at least one of the scan electrode or the sustain electrode in a sustain period of one or more subfields of a frame subsequent to the threshold duration of time can be controlled. As a result, the image sticking decreases. This will be described in detail below.

Figure 5:
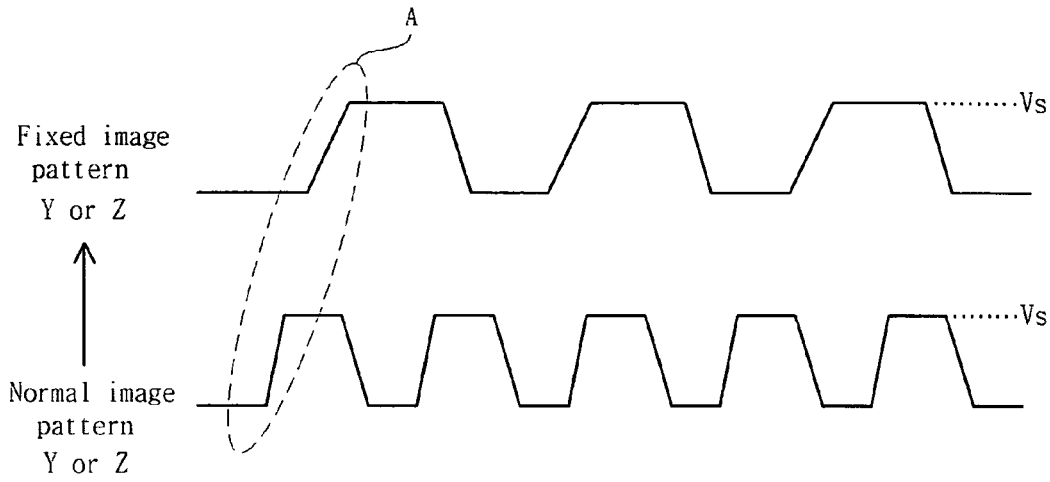
FIG. 5 illustrates a method of driving the plasma display apparatus according to the first embodiment of the present invention.

FIG. 5 illustrates a method of driving the plasma display apparatus according to the first embodiment of the present invention.

As illustrated in FIG. 5, wherein when an image displayed on the plasma display apparatus is a fixed image pattern which has a rate of change equal to or less than a threshold rate of change in input image data and is displayed as a picture for a duration equal to or more than a threshold duration of time, the number of sustain pulses supplied to at least one of the scan electrode Y or the sustain electrode Z in a sustain period of a subfield subsequent to the threshold duration of time is controlled. For example, as illustrated in FIG. 5, in a case of a normal image pattern, five sustain pulses are supplied to at least one of the scan electrode Y or the sustain electrode Z in the sustain period. On the other hand, in a case of the fixed image pattern, three sustain pulses are supplied to at least one of the scan electrode Y or the sustain electrode Z in the sustain period, thereby reducing image sticking.

When the fixed image pattern, in which a rate of change in sequentially input image data of the frame is less than the threshold rate of change, is displayed on the plasma display apparatus for a duration equal to or more than the threshold duration of time, the state of the wall charges distributed within the discharge cell is fixed.

Sustain pulses with similar patterns supplied in response to the image data with the rate of change equal to or less than the threshold rate of change causes the fixation of a phosphor. Accordingly, although next image data is input to the screen, the fixed image pattern caused by the previous image data remains in an image directly after the previous image as the image sticking. In other words, since a state of the wall charges is fixed and a sustain pulse is applied in the fixed state of the wall charges, image sticking occurs on the screen.

To overcome the generation of the image sticking, in the embodiment of the present invention, the sustain pulse supplied in the sustain period in response to image data of the fixed image pattern has various patterns so that the fixed state of the wall charges is suppressed.

More preferably, in the embodiment of the present invention, the number of sustain pulses supplied to at least one of the scan electrode or the sustain electrode in the sustain period in the fixed image pattern is less than the number of sustain pulses supplied in a normal image pattern. Therefore, intensity of a discharge is weak and the state of the wall charge distributed in the discharge cell is not fixed so that the generation of the image sticking is suppressed.

The threshold rate of change of the fixed image pattern is expressed by a percentage of a difference between image data of a present frame and image data of a frame directly before the present frame. The threshold rate of change of the fixed image pattern equals to or less than 10% of the total image data input during one frame. The threshold duration of time of the fixed image pattern equals 1 second.

When an image displayed on the plasma display apparatus is the fixed image pattern, as illustrated by a reference symbol A in FIG. 5, a slope of the sustain pulse can be controlled other than the control of the number of sustain pulses. This will be described in detail with reference to FIG. 6.

Figure 6:
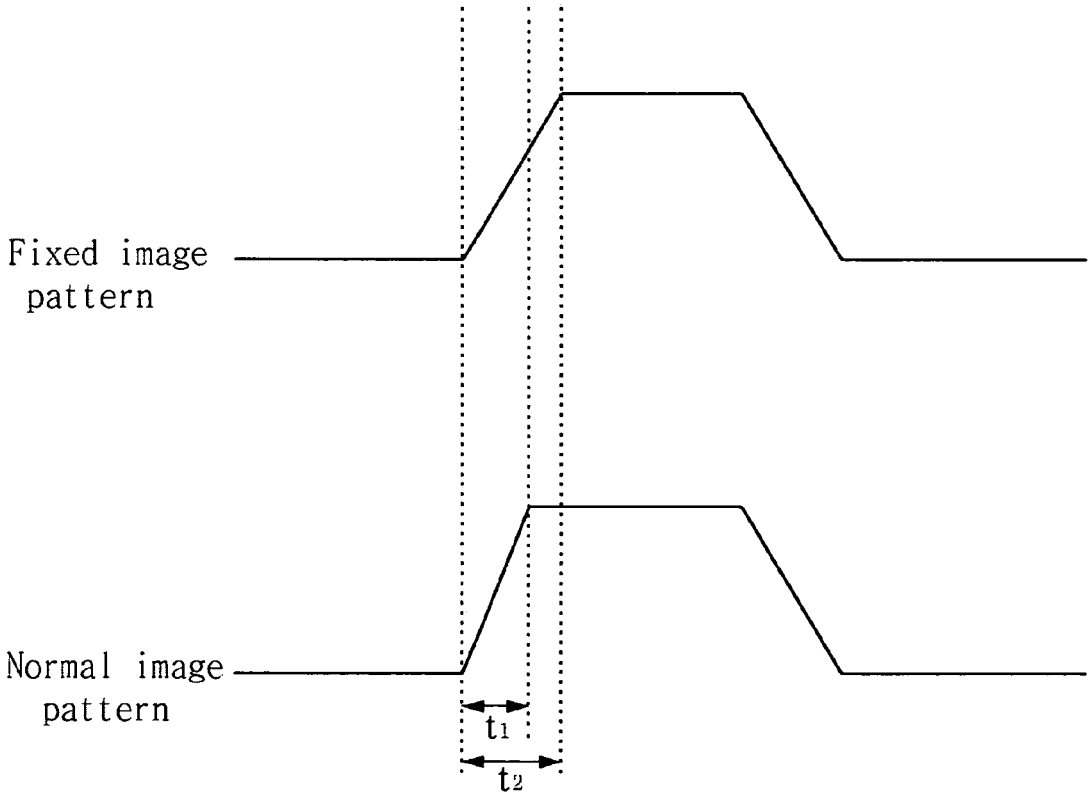
FIG. 6 illustrates an energy supply period of a sustain pulse of the driving waveform in the plasma display apparatus according to the first embodiment of the present invention.

FIG. 6 illustrates an energy supply period of a sustain pulse of the driving waveform in the plasma display apparatus according to the first embodiment of the present invention.

An energy supply period ranges from a supply start time point of the sustain pulse supplied to at least one of the scan electrode or the sustain electrode in the sustain period to a time point when a voltage of the sustain pulse equals to the sustain voltage Vs. As illustrated in FIG. 6, an energy supply period in the normal image pattern equals to a period t1, and an energy supply period in the fixed image pattern equals to a period t2. In other words, while the number of sustain pulses in the fixed image pattern is less than the number of sustain pulses in the normal image pattern, the duration of the energy supply period in the fixed image pattern is more than the duration of the energy supply period in the normal image pattern. As a result, a change in voltages of the sustain pulse (that is, a slope of the sustain pulse) supplied in the sustain period in the fixed image pattern decreases, so that the state of the distribution of the wall charge is not fixed and the generation of the image sticking is suppressed.

More preferably, although it is not shown in the drawings, a negative sustain pulse may be supplied to at least one of the scan electrode or the sustain electrode in the sustain period. As a result, positive ions heavier than electrons are accumulated on the sustain electrode formed on the front substrate of the plasma display panel. The influence a discharge generated in the sustain electrode on the phosphor formed on the rear substrate opposite the front substrate is minimized, so that the image sticking of the image displayed by the phosphor is efficiently removed The number of sustain pulses may be controlled in accordance with a change in the threshold duration of time of the fixed image pattern. This will be described in detail with reference to FIG. 7.

Figure 7:
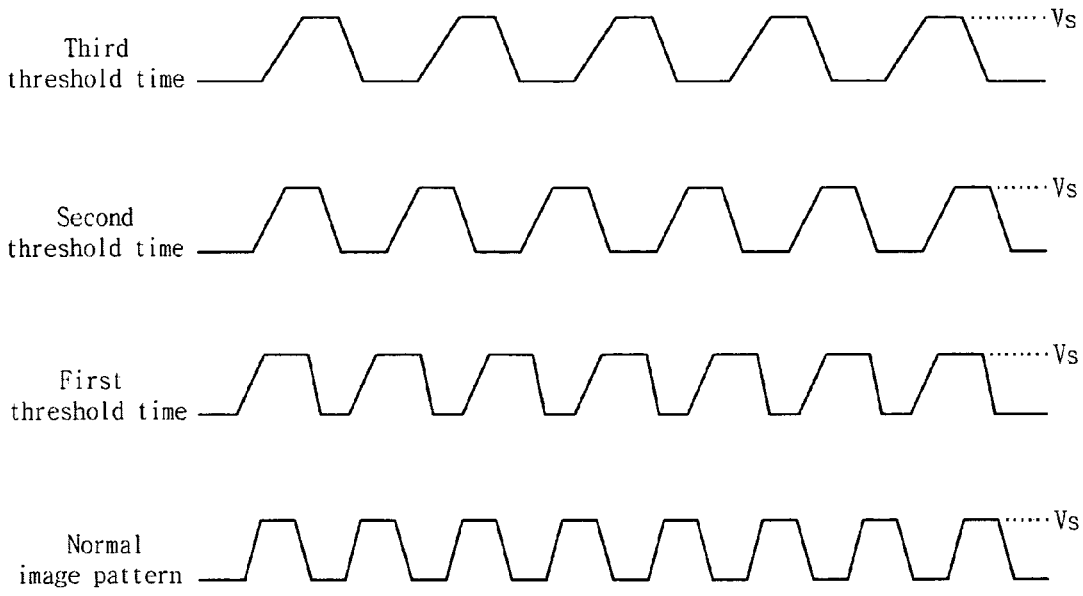
FIG. 7 illustrates a relationship between a threshold duration of time and the number of sustain pulses in the driving waveform of the plasma display apparatus according to the first embodiment of the present invention.

FIG. 7 illustrates a relationship between a threshold duration of time and the number of sustain pulses in the driving waveform of the plasma display apparatus according to the first embodiment of the present invention.

As a display duration of time of an image, in which a rate of change in image data input for the duration equal to or more than the threshold duration of time of the fixed image pattern is equal to or less than the threshold rate of change of the fixed image pattern, increases, the number of sustain pulses supplied to at least one of the scan electrode or the sustain electrode in the sustain period of the subfield subsequent to the threshold duration of time of the fixed image pattern further decreases.

More preferably, when a display duration of time of an image, in which the rate of change in the image data is equal to or less than the threshold rate of change of the fixed image pattern, increases, the decrease number of sustain pulses is fixed.

As illustrated in FIG. 7, the threshold duration of time is divided into two or more threshold durations of time at regularly time intervals. The threshold duration of time includes a first threshold duration of time and a second threshold duration of time later than the first threshold duration of time. The number of sustain pulses supplied between the first threshold duration of time and the second threshold duration of time is more than the number of sustain pulses supplied subsequent to second threshold duration of time. In other words, the threshold duration of time is divided into n threshold durations of time. As the duration of the threshold duration of time increases, the number of sustain pulses regularly decreases. For example, the number of sustain pulses in the first threshold duration of time is more than the number of sustain pulses in the second threshold duration of time by one sustain pulse.

As described above, as the display duration of time of an image, in which the rate of change in the image data input for the duration equal to or more than the threshold duration of time of the fixed image pattern is equal to or less than the threshold rate of change of the fixed image pattern, increases, the number of sustain pulses supplied to at least one of the scan electrode or the sustain electrode in the sustain period of the subfield subsequent to the threshold duration of time of the fixed image pattern decreases. As a result, the fixed state of the wall charge distributed within the discharge cell is efficiently improved.

A magnitude of a voltage of the sustain pulse may be controlled other than the control of the number of sustain pulses. This will be described in detail with reference to FIG. 8.

Figure 8:
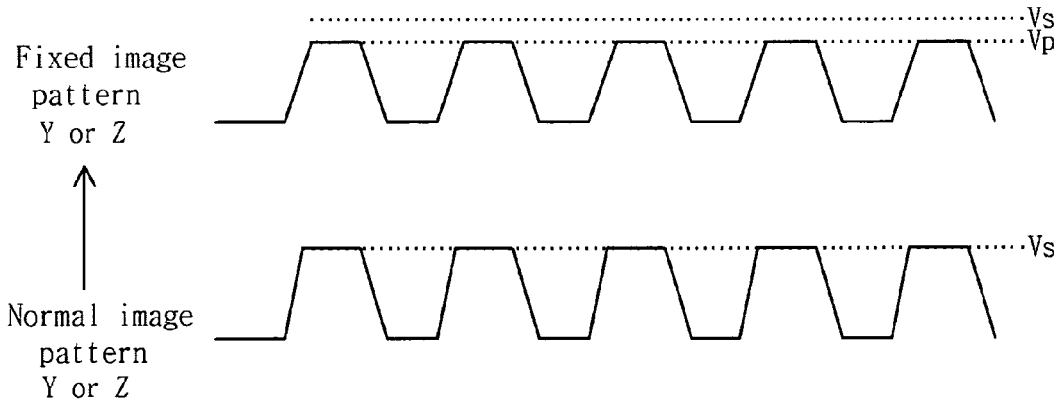
FIG. 8 illustrates another method of driving the plasma display apparatus according to the first embodiment of the present invention.

FIG. 8 illustrates another method of driving the plasma display apparatus according to the first embodiment of the present invention.

When an image displayed on the plasma display apparatus is the fixed image pattern which has the rate of change equal to or less than the threshold rate of change in input image data and is displayed as a picture for a duration equal to or more than the threshold duration of time, a magnitude of a voltage of a sustain pulse supplied to at least one of the scan electrode or the sustain electrode in the sustain period of the subfield subsequent to the threshold duration of time is controlled. For example, as illustrated in FIG. 8, a peak voltage of a sustain pulse supplied to at least one of the scan electrode or the sustain electrode in the normal image pattern equals to the sustain voltage Vs. A peak voltage of a sustain pulse supplied to at least one of the scan electrode or the sustain electrode in the fixed image pattern equals to a voltage Vp less than the sustain voltage Vs. As a result, the fixed state of the wall charge distributed within the discharge cell is efficiently improved.

Although it is not shown in the drawings, a negative sustain pulse may be supplied to at least one of the scan electrode or the sustain electrode in the sustain period. As a result, positive ions heavier than electrons are accumulated on the sustain electrode formed on the front substrate of the plasma display panel. The influence a discharge generated in the sustain electrode on the phosphor formed on the rear substrate opposite the front substrate is minimized, so that the image sticking of the image displayed by the phosphor is efficiently removed The magnitude of the voltage of the sustain pulse may be controlled in accordance with a change in the threshold duration of time of the fixed image pattern. This will be described in detail with reference to FIG. 9.

Figure 9:
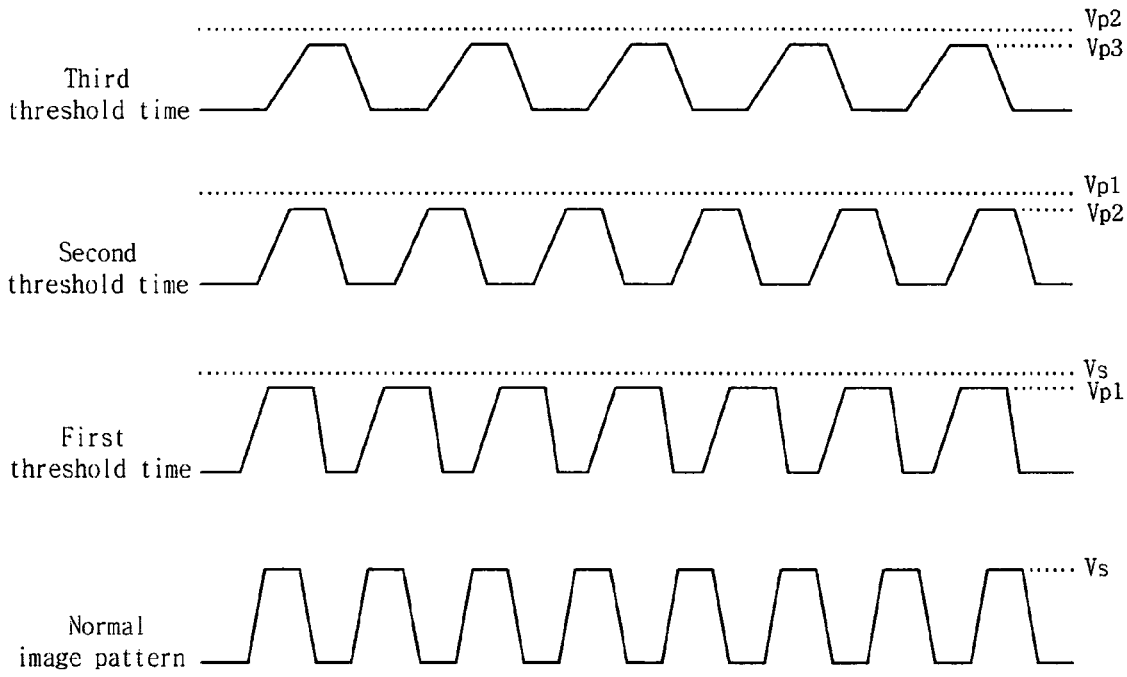
FIG. 9 illustrates a relationship between a threshold duration of time and a voltage of the sustain pulses in another method of driving the plasma display apparatus according to the first embodiment of the present invention.

FIG. 9 illustrates a relationship between a threshold duration of time and a voltage of the sustain pulses in another method of driving the plasma display apparatus according to the first embodiment of the present invention.

As a display duration of time of an image, in which a rate of change in image data input for the duration equal to or more than the threshold duration of time of the fixed image pattern is equal to or less than the threshold rate of change of the fixed image pattern, increases, the magnitude of the voltage of the sustain pulse supplied to at least one of the scan electrode or the sustain electrode in the sustain period of the subfield subsequent to the threshold duration of time of the fixed image pattern further decreases.

More preferably, when a display duration of time of an image, in which the rate of change in the image data is equal to or less than the threshold rate of change of the fixed image pattern, increases, the magnitude of the voltage of the sustain pulse is fixed.

As illustrated in FIG. 9, the threshold duration of time is divided into two or more threshold durations of time at regularly time intervals. The threshold duration of time includes a first threshold duration of time and a second threshold duration of time later than the first threshold duration of time. A magnitude of a voltage of a sustain pulse supplied between the first threshold duration of time and the second threshold duration of time is more than A magnitude of a voltage of a sustain pulse supplied subsequent to the second threshold duration of time. In other words, the threshold duration of time is divided into n threshold durations of time. As the duration of the threshold duration of time increases, a magnitude of a voltage of a sustain pulse regularly decreases. For example, as illustrated in FIG. 9, a magnitude of a voltage sequentially decreases in order of voltages Vp1, Vp2, Vp3.

As described above, as the display duration of time of an image, in which the rate of change in the image data input for the duration equal to or more than the threshold duration of time of the fixed image pattern is equal to or less than the threshold rate of change of the fixed image pattern, increases, the magnitude of the voltage of the sustain pulse supplied to at least one of the scan electrode or the sustain electrode in the sustain period of the subfield subsequent to the threshold duration of time of the fixed image pattern decreases. As a result, the fixed state of the wall charge distributed within the discharge cell is efficiently improved.

In the plasma display apparatus according to the embodiment of the present invention, the number of sustain pulses or the magnitude of the voltage of the sustain pulse supplied to at least one of the scan electrode or the sustain electrode in a sustain period of one or more subfields of a frame is controlled depending on a pattern of an input image. As a result, the fixed state of the wall charge distributed within the discharge cell efficiently decreases.

It will be obvious that the invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising a scan electrode and a sustain electrode; and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, the number of sustain pulses supplied to at least one of the scan electrode or the sustain electrode in a sustain period of a subfield subsequent to the threshold duration of time is controlled.

2. The plasma display apparatus of claim 1, wherein when an image displayed on the plasma display apparatus is the fixed image pattern, the number of sustain pulses supplied to at least one of the scan electrode or the sustain electrode in a sustain period of a subfield subsequent to the threshold duration of time of the fixed image pattern is less than the number of sustain pulses supplied to at least one of the scan electrode or the sustain electrode in a normal image pattern.

3. The plasma display apparatus of claim 2, wherein when an image displayed on the plasma display apparatus is the fixed image pattern, the duration of an energy supply period of the sustain pulse supplied to at least one of the scan electrode or the sustain electrode in the sustain period of the subfield subsequent to the threshold duration of time of the fixed image pattern is more than the duration of an energy supply period of a sustain pulse supplied to at least one of the scan electrode or the sustain electrode in the normal image pattern.

4. The plasma display apparatus of claim 2, wherein the driver supplies a negative sustain pulse to at least one of the scan electrode or the sustain electrode in the sustain period.

5. The plasma display apparatus of claim 2, wherein the threshold rate of change of the fixed image pattern is expressed by a percentage of a difference between the image data of a present frame and the image data of a frame directly before the present frame, and the threshold rate of change of the fixed image pattern is equal to or less than 10% of the total image data input during one frame.

6. The plasma display apparatus of claim 2, wherein the threshold duration of time of the fixed image pattern equals 1 second.

7. The plasma display apparatus of claim 2, wherein as a display duration of time of an image, in which a rate of change in the image data input for the duration equal to or more than the threshold duration of time of the fixed image pattern is equal to or less than the threshold rate of change of the fixed image pattern, increases, the number of sustain pulses supplied to at least one of the scan electrode or the sustain electrode in the sustain period of the subfield subsequent to the threshold duration of time of the fixed image pattern decreases.

8. The plasma display apparatus of claim 7, wherein when a display duration of time of an image, in which the rate of change in image data input for the duration equal to or more than the threshold duration of time of the fixed image pattern is equal to or less than the threshold rate of change of the fixed image pattern, increases, the decrease number of sustain pulses is fixed.

9. A plasma display apparatus comprising:

a plasma display panel comprising a scan electrode and a sustain electrode; and a driver for supplying a driving voltage to each of the scan electrode and the sustain electrode, wherein when an image displayed on the plasma display apparatus is a fixed image pattern which has a rate of change equal to or less than a threshold rate of change in input image data and is displayed as a picture for a duration equal to or more than a threshold duration of time, a magnitude of a voltage of a sustain pulse supplied to at least one of the scan electrode or the sustain electrode in a sustain period of a subfield subsequent to the threshold duration of time is controlled.

10. The plasma display apparatus of claim 9, wherein when an image displayed on the plasma display apparatus is the fixed image pattern, a magnitude of a voltage of a sustain pulse supplied to at least one of the scan electrode or the sustain electrode in a sustain period of a subfield subsequent to the threshold duration of time of the fixed image pattern is less than a magnitude of a voltage of a sustain pulse supplied to at least one of the scan electrode or the sustain electrode in a normal image pattern.

11. The plasma display apparatus of claim 10, wherein the driver supplies a negative sustain pulse to at least one of the scan electrode or the sustain electrode in the sustain period.

12. The plasma display apparatus of claim 10, wherein the threshold rate of change of the fixed image pattern is expressed by a percentage of a difference between image data of a present frame and image data of a frame directly before the present frame, and the threshold rate of change of the fixed image pattern is equal to or less than 10% of the total image data input during one frame.

13. The plasma display apparatus of claim 10, wherein the threshold duration of time of the fixed image pattern equals 1 second.

14. The plasma display apparatus of claim 10, wherein as a display duration of time of an image, in which a rate of change in image data input for the duration equal to or more than the threshold duration of time of the fixed image pattern is equal to or less than the threshold rate of change of the fixed image pattern, increases, a magnitude of a voltage of a sustain pulse supplied to at least one of the scan electrode or the sustain electrode in the sustain period of the subfield subsequent to the threshold duration of time of the fixed image pattern decreases.

15. The plasma display apparatus of claim 14, wherein when a display duration of time of an image, in which the rate of change in image data input for the duration equal to or more than the threshold duration of time of the fixed image pattern is equal to or less than the threshold rate of change of the fixed image pattern, increases, a magnitude of a voltage of a sustain pulses is fixed.

16. A method of driving a plasma display apparatus comprising a scan electrode and a sustain electrode, comprising:

when an image displayed on the plasma display apparatus is a fixed image pattern which has a rate of change equal to or less than a threshold rate of change in input image data and is displayed as a picture for a duration equal to or more than a threshold duration of time, controlling the number of sustain pulses or a magnitude of a voltage of a sustain pulse supplied to at least one of the scan electrode or the sustain electrode in a sustain period of a subfield subsequent to the threshold duration of time.

17. The method of claim 16, wherein when an image displayed on the plasma display apparatus is the fixed image pattern, the number of sustain pulses supplied to at least one of the scan electrode or the sustain electrode in a sustain period of a subfield subsequent to the threshold duration of time of the fixed image pattern is less than the number of sustain pulses supplied to at least one of the scan electrode or the sustain electrode in a normal image pattern.

18. The plasma display apparatus of claim 16, wherein the threshold rate of change of the fixed image pattern is expressed by a percentage of a difference between image data of a present frame and image data of a frame directly before the present frame, and the threshold rate of change of the fixed image pattern is equal to or less than 10% of the total image data input during one frame.

19. The plasma display apparatus of claim 16, wherein the threshold duration of time of the fixed image pattern equals 1 second.

* * * * *